US008967049B2

(12) United States Patent
Scheid et al.

(10) Patent No.: US 8,967,049 B2
(45) Date of Patent: Mar. 3, 2015

(54) SOLID LINED FABRIC AND A METHOD FOR MAKING

(71) Applicants: Eric Scheid, Bloomington, IN (US); Colt Miller, Bloomington, IN (US)

(72) Inventors: Eric Scheid, Bloomington, IN (US); Colt Miller, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 66 days.

(21) Appl. No.: 13/732,695

(22) Filed: Jan. 2, 2013

(65) Prior Publication Data

US 2014/0060374 A1 Mar. 6, 2014

Related U.S. Application Data

(63) Continuation-in-part of application No. 13/016,925, filed on Jan. 28, 2011, now Pat. No. 8,671,840.

(60) Provisional application No. 61/582,569, filed on Jan. 3, 2012.

(51) Int. Cl.

| | |
|---|---|
| ***F42B 12/22*** | (2006.01) |
| ***F42B 12/32*** | (2006.01) |
| ***F41H 5/04*** | (2006.01) |

(52) U.S. Cl.

CPC ..... *F42B 12/22* (2013.01); *F42B 12/32* (2013.01); *F41H 5/0492* (2013.01)

USPC ..... 102/495; 102/491

(58) Field of Classification Search

CPC ..... F42B 3/087; F42B 3/093; F42B 12/02; F42B 12/202; F42B 12/22; F42B 12/24; F42B 12/32; F42B 12/367; F42B 12/56

USPC ..... 102/473, 491, 492, 493, 494, 495, 496, 102/497, 303, 389; 89/36.17, 902, 912

See application file for complete search history.

(56) References Cited

U.S. PATENT DOCUMENTS

| | | | | | |
|---|---|---|---|---|---|
| 1,758,296 | A | | 5/1930 | Schaumann | |
| 2,023,158 | A | * | 12/1935 | Williams | 102/482 |
| 2,972,949 | A | * | 2/1961 | MacLeod | 102/401 |
| 3,298,308 | A | * | 1/1967 | Throner, Jr. | 102/496 |
| 3,757,693 | A | * | 9/1973 | Shea | 102/493 |
| 3,799,054 | A | | 3/1974 | LaRocca | |
| 3,801,416 | A | * | 4/1974 | Gulbierz | 109/49.5 |
| 3,867,239 | A | | 2/1975 | Alesi et al. | |
| 3,924,038 | A | | 12/1975 | McArdle et al. | |
| 3,977,327 | A | | 8/1976 | Brumfield et al. | |
| 4,106,410 | A | * | 8/1978 | Borcher et al. | 102/495 |
| 4,211,169 | A | * | 7/1980 | Brothers | 102/494 |
| 4,316,286 | A | | 2/1982 | Klein | |

(Continued)

*Primary Examiner* — Bret Hayes
*Assistant Examiner* — Derrick Morgan
(74) *Attorney, Agent, or Firm* — Christopher A. Monsey

(57) ABSTRACT

An apparatus being a lined fabric material is disclosed. One embodiment of the lined fabric is used as an augmentation sleeve for use with a non lethal, explosive device and includes a lined material having a liner material in between a first fabric and a second fabric, where at least said first fabric is likely to rupture when an explosive force being substantially applied to a liner material in said lined fabric. A liner material is a material that reduces the likelihood of injury when expelled from the lined fabric and contacts a person. The fabric material has some properties of flexible light weight material properties and also has the properties of substantially rigid materials.

41 Claims, 12 Drawing Sheets

(56) References Cited

U.S. PATENT DOCUMENTS

| | | | | | |
|---|---|---|---|---|---|
| 4,493,264 | A | * | 1/1985 | Jameson | 102/491 |
| 4,648,323 | A | | 3/1987 | Lawther | |
| 4,660,223 | A | | 4/1987 | Fritch | |
| 4,817,532 | A | | 4/1989 | Assmann | |
| 4,899,661 | A | | 2/1990 | Kaelin | |
| 4,911,061 | A | * | 3/1990 | Pivitt et al. | 89/36.02 |
| 4,923,728 | A | | 5/1990 | Snedeker | |
| 4,982,668 | A | | 1/1991 | Bender et al. | |
| H001048 | H | * | 5/1992 | Wilson et al. | 102/496 |
| 5,196,252 | A | | 3/1993 | Harpell | |
| 5,313,890 | A | * | 5/1994 | Cuadros | 102/496 |
| 5,362,527 | A | * | 11/1994 | Harpell et al. | 428/33 |
| 5,368,930 | A | | 11/1994 | Samples | |
| 5,515,541 | A | | 5/1996 | Sacks et al. | |
| 5,601,895 | A | | 2/1997 | Cunningham | |
| 5,877,448 | A | * | 3/1999 | Denton et al. | 102/401 |
| 5,996,115 | A | | 12/1999 | Mazelsky | |
| 6,298,788 | B1 | * | 10/2001 | Woods et al. | 102/502 |
| 6,370,690 | B1 | | 4/2002 | Neal | |
| 6,453,819 | B1 | * | 9/2002 | Coates | 102/498 |
| 6,470,784 | B1 | * | 10/2002 | Bonavita et al. | 89/36.17 |
| 6,668,727 | B1 | | 12/2003 | Kim et al. | |
| 6,857,372 | B2 | | 2/2005 | Renaud-Bezot et al. | |
| 7,067,031 | B2 | | 6/2006 | deWitt | |
| 7,363,846 | B1 | * | 4/2008 | Dean et al. | 89/36.05 |
| 7,472,652 | B1 | | 1/2009 | Scheid | |
| 7,504,145 | B2 | * | 3/2009 | Vance et al. | 428/76 |
| 7,543,534 | B1 | * | 6/2009 | Manole et al. | 102/513 |
| 7,568,430 | B1 | * | 8/2009 | Conley et al. | 102/293 |
| 7,621,222 | B2 | * | 11/2009 | Lloyd | 102/497 |
| 7,793,579 | B1 | | 9/2010 | Lee | |
| 8,069,494 | B2 | * | 12/2011 | Sundnes | 2/2.5 |
| 8,671,840 | B2 | * | 3/2014 | Scheid et al. | 102/495 |
| 2005/0087088 | A1 | * | 4/2005 | Lacy et al. | 102/495 |
| 2009/0078147 | A1 | * | 3/2009 | Ronn | 102/494 |
| 2012/0192754 | A1 | * | 8/2012 | Scheid et al. | 102/495 |

* cited by examiner

SOLID LINED FABRIC AND A METHOD FOR MAKING

CROSS REFERENCE TO RELATED APPLICATION(S)

This invention claims the benefit of U.S. Provisional Application No. 61/582,569, filed Jan. 3, 2012 and is a continuation-in-part of U.S. patent application Ser. No. 13/016,925, filed on Jan. 28, 2011, the contents of which is hereby incorporated by reference in its entirety.

STATEMENT REGARDING FEDERALLY SPONSORED RESEARCH OR DEVELOPMENT

The invention described herein was made in the performance of official duties by employees of the Department of the Navy and may be manufactured, used, or licensed by or for the United States Government for any governmental purpose without payment of any royalties thereon.

BACKGROUND OF THE INVENTION

Currently, when making a product, designers, manufacturers and individuals have to choose between a flexible, light weight material and un-flexible, relatively solid material. Flexible fabric could include natural materials, such as cotton, wool, hemp, and linen, and manufactured materials, such as polyester, rayon, and spandex. In certain situations, designers may desire a fabric with more tensile strength and abrasion resistance, therefore a designer may employ a fabric like material, such as a foil, mesh, or screen. These materials may be lightweight and flexible, but lack properties of a more rigid material.

However, when manufacturing certain products, it may desirable to employ a material that has rigid properties: strong, hard, dense, inflexible, and compressive strength. For example, depending on the desired properties, a designer may select steel or other metal, hardened plastic, or wood. These rigid materials may be strong and hard, but lack properties of a more flexible material.

It would be desirable to have a fabric that has some properties of flexible light weight material properties and also has the properties of substantially rigid materials.

There are situations where it is preferable an exterior fabric be strong, but not too strong, so as to provide access, contact, or effect of a liner material contained behind or within the exterior fabric. For example, there are situations where it is desirable that an exterior fabric is breathable or porous so that the environment would have contact with the liner material. The selection of the exterior fabric directly impacts the environment's interaction with the liner material; thus, if the exterior fabric is too strong or too dense, for example, then the fabric would be less breathable or porous and therefore hinder access to the liner material. Alternatively, there are situations where an exterior fabric is used to convey liner material, and at an appropriate point, the exterior fabric releases the liner material. If the exterior fabric is to strong, then it will not release the liner material, if it is too weak, then the exterior fabric may securely contain the liner material.

In another aspect, there are situations where an exterior fabric bolsters the effect of its liner material. For example, when creating body armor it is desirable that the exterior fabric be strong, dense, and resilient to ideally support and not hinder the effects of a strong, resilient liner material.

Thus, it would be desirable to have a fabric that has an exterior fabric that bolsters the desired effect of the interior liner material.

BRIEF DESCRIPTION OF THE DRAWINGS

FIG. 1(*b*) depicts a plan view of a portion of lined fabric in accordance with a first exemplary embodiment of the invention;

FIGS. 2(*b*)-(*e*) depict a portion of the application of FIG. 2(*a*);

FIGS. 6(*b*)-(*e*) depict a portion of the application of FIG. 6(*a*);

DETAILED DESCRIPTION OF THE INVENTION

In the following detailed description, reference is made to the accompanying drawings, which form a part hereof, and in which are shown by way of illustration specific exemplary embodiments of the invention. These embodiments are described in sufficient detail to enable those of ordinary skill in the art to make and use the invention, and it is to be understood that structural, logical, or other changes may be made to the specific embodiments disclosed without departing from the spirit and scope of the present invention.

The invention seeks to address a deficiency between light weight, flexible materials and rigid materials. The invention discloses a lined fabric that has substantially characteristics of a rigid material while maintaining the flexibility and versatility of a fabric.

The invention also discloses a fabric that has an exterior fabric that bolsters the desired effect of the interior liner material.

Figure 1A:
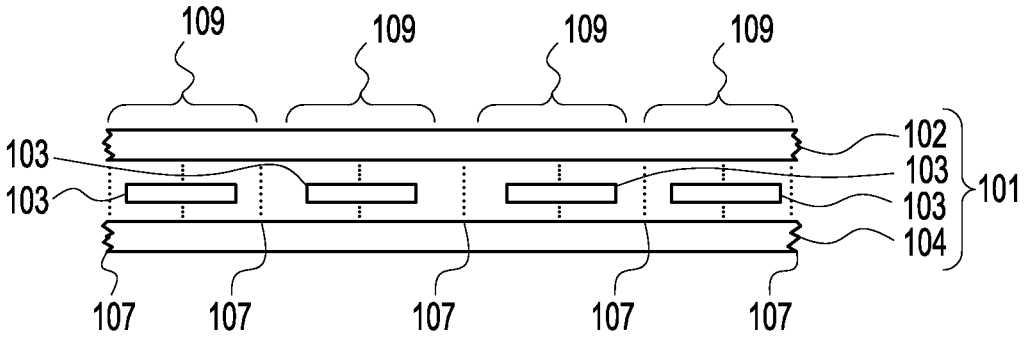
FIG. 1(*a*) depicts a cross sectional view of a portion of lined fabric in accordance with a first exemplary embodiment of the invention.
Figure 1B:
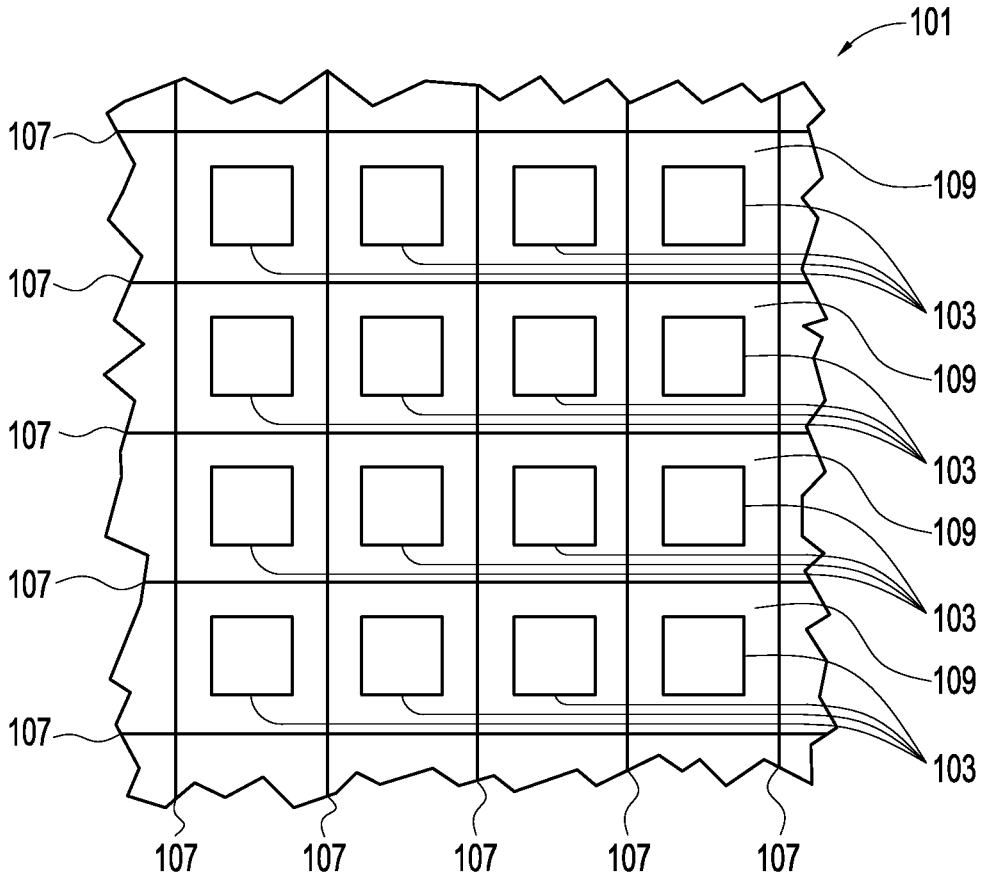
Figure 2A:
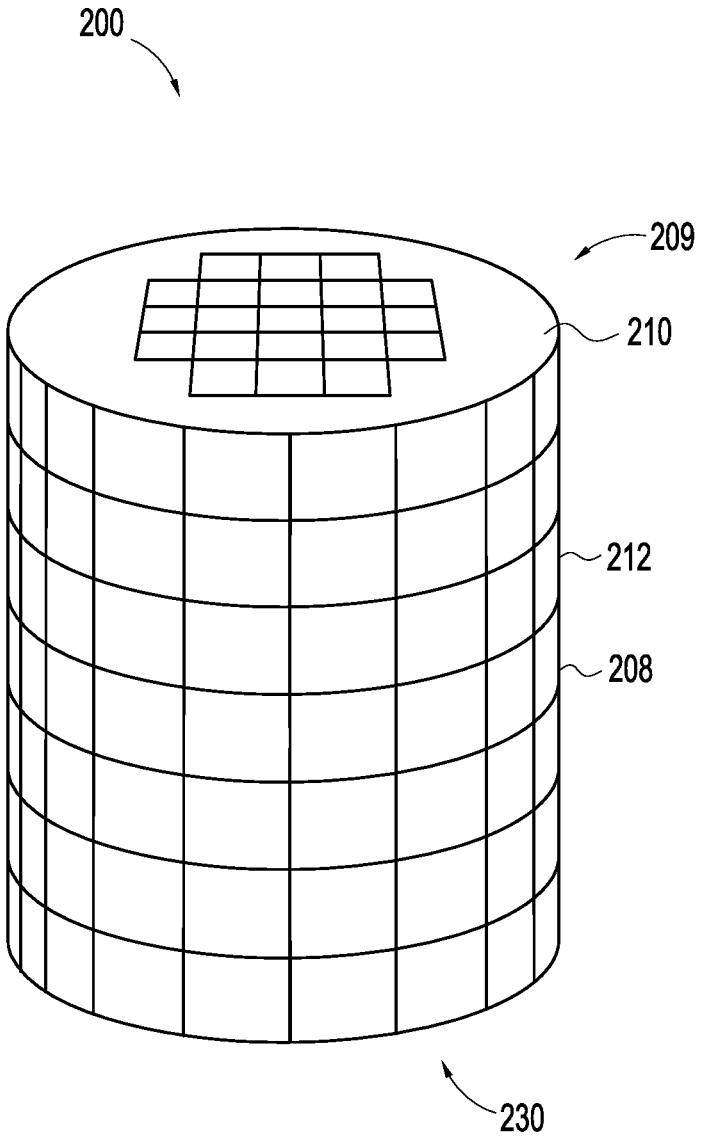
FIG. 2(*a*) depicts an application of the lined fabric in accordance with an exemplary embodiment of the invention.
Figure 2B:
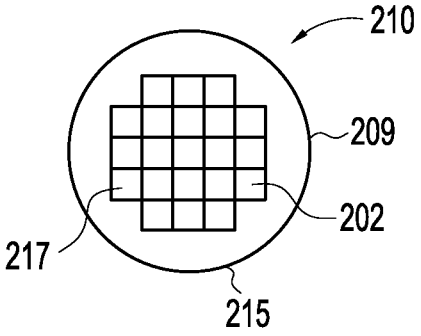
Figure 2C:
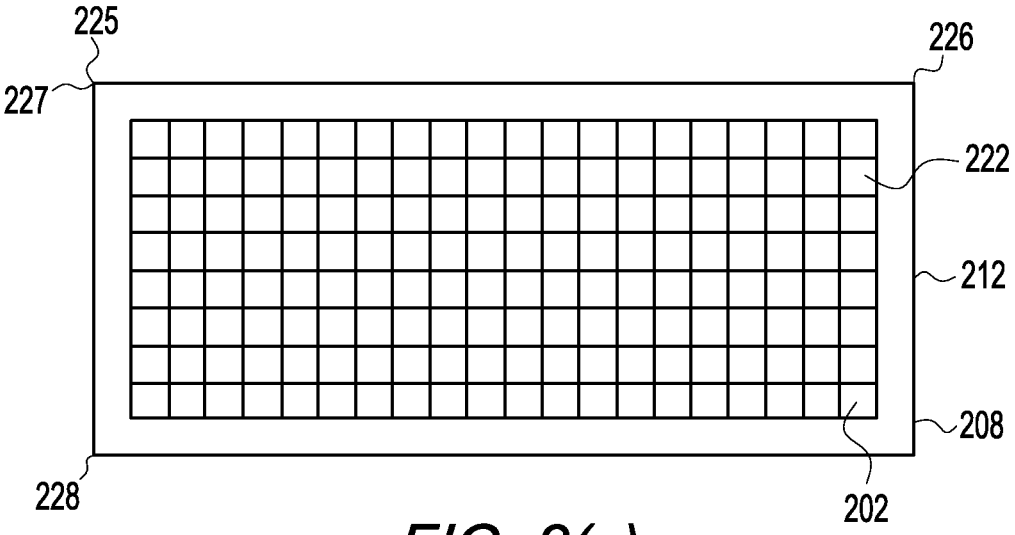
Figure 2D:
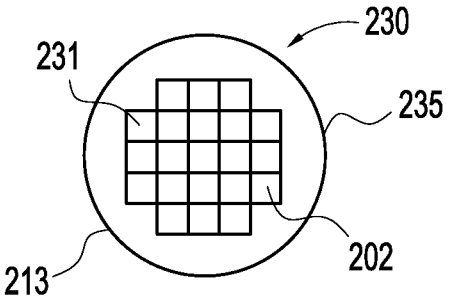
Figure 2E:
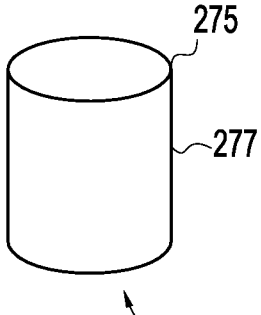

FIG. 1(*a*) depicts a cross sectional view of a portion of lined fabric 101 in accordance with a first exemplary embodiment of the invention. The lined fabric 101 includes several elements: a first fabric material 102, a second fabric material 104, a liner material 103, and fastening material 107. The portion of the lined fabric 101 depicted in FIG. 1(*a*) is representational of the arrangement of the elements throughout a whole piece of lined fabric 101.

A cell 109 of the lined fabric 101 is comprised of a portion of the lined fabric 101 bounded by neighboring fastening materials 107. Thus, each cell 109 includes a portion of the lined fabric 101: a portion of a first fabric material 102, a portion of the second fabric material 104, a portion of the liner material 103, and a portion of the fastening material 107. FIG. 1(*a*) depicts the cross sectional view of four (4) cells 109. In effect, the cell 109 is a pocket formed by the first fabric material 102 and the second fabric material 104 and the liner material 103 is disposed within the pocket.

FIG. 1(*b*) depicts a plan view of a portion of lined fabric 101. In an exemplary approach, the lined fabric 101 would be provided in sheets which would be cut and assembled through the use of patterns, similar to a conventional fabric. The lined fabric 101 shows sixteen (16) cells 109, having liner material 103, and fastening material 107. Although not shown, there may exist areas in the lined fabric 101 without cells, for example, border areas, generally formed by the first fabric 102 and the second fabric 104 without any liner material 103.

FIG. 1 (*a*) is an exploded view of the lined fabric 101 to be representational of the arrangement of elements in the lined fabric 101. However, in a preferred approach, for each cell 109: at least a portion of a first fabric material 102 is in contact with a portion of the liner material 103, most likely, a first side of liner material 103. Furthermore, at least a portion of a second fabric material 104 is in contact with a portion of the liner material 103, most likely, a second side of liner material 103. If the liner material 103 within the cell 109 is smaller than the size of the cell 109, then at least a portion of a first fabric material 102 may be in contact with the second fabric material 104 in an area between the liner material 103 and a fastening material 107.

On the border of a cell 109, a first fabric material 102 may be in contact with a portion of the second fabric material 104 depending on the selection of fastening material 107. If, for example, the fastening material 107 is a type of thread then stitching the thread causes first fabric material 102 to be contact the second fabric material 104. If, in another example, if the fastening material 107 is a type of glue then the first fabric material 102 is substantially in contact with the second fabric material 104 through the glued fastening material placed between the materials. In an aspect of the invention, liner material 103 is not fastened to either of fabric materials 102, 104, and is contained within a cell 109 by the borders of the cell 109 formed by fastening fabric material 102 to fabric material 104. The movement of the liner material 103 within a cell 109 may be dependent on the correlation of the characteristics of the liner material 103 to the characteristics of the cell 109. For example, if the size of the liner material 103 is smaller than the size of the cell 109, then the liner material 103 will likely be able to move around within the cell 109. For example, if the size of the liner material 103 is approximately the same size as cell 109, then the liner material 103 will not be likely be to move around within the cell 109, as the liner material 103 is likely to be snug within the cell 109. In another aspect of the invention, liner material 103 is fastened to either or both of fabric materials 102, 104 by any conventional fastening means.

FIG. 2(*a*) depicts an application of the lined fabric 101 in accordance with an exemplary embodiment of the invention. FIG. 2(*a*) shows, in a perspective line drawing, a lined fabric 101 used as a fragmentation sleeve 200 for use with a source of strong kinetic energy—a kinetic apparatus, e.g., an explosive ordnance. The explosive device has a significant amount of force that is generated when detonated. For example, for small, handheld explosive devices, the explosive force could be 400-800 kJoules of energy. The lined fabric 101 is placed on/over an explosive device, with the second fabric material 104 in contact with the explosive device. When the explosive device explodes, the force of the explosion is carried through the backside of the lined fabric 101, through the second fabric material 104 to the liner material 103 and the liner material 103 is expelled from the lined fabric 101, most likely by rupturing/tearing and passing through the first fabric material 102. In another approach, the second fabric material is consumed by the kinetic force of the kinetic apparatus. Thus, a goal of the fabric is to have the liner material 103 be expelled from the lined fabric 101, where the lined fabric 101 is secure enough to maintain the liner material 103, but not too secure such that fabric does not significantly affect kinetic energy being received by the liner material 103, and such that it does not significantly affect the liner material 103 from rupturing the lined fabric 101 and being expelled through it. Small steel squares, made from ⅛ inch sheet steel, cut in one-quarter (¼) inch pieces are used as liner material 103 and are imbedded in a lightweight fabric; one steel square in each cell. As is known, steel generally has a density of 7850 kg/m$^3$.

In this example, the explosive device is substantially cylindrically shaped. Thus, it must be determined how best to wrap the device in a cover with the lined fabric 101. It is likely that the design for the shape of the cover would be broken into constituent parts. As the device is shaped like a cylinder, it is reasonable to fashion a cover by making a top, bottom, and side, where the top and bottom are circular and substantially the same, and the side is substantially rectangular. The lined fabric is fashioned into a cover, e.g., a fragmentation sleeve 200, appearing to be a cylindrical object as seen in FIG. 2(*a*) The fragmentation sleeve 200 has a top 210, a bottom 230 (not seen in this view), and side 212. The top 210 of the fragmentation sleeve 200 is formed from a first lined fabric 209. The side 212 of the fragmentation sleeve 200 is formed from a second lined fabric 208.

FIG. 2(*b*) depicts a plan view of the top of the fragmentation sleeve of FIG. 2(*a*). As seen in FIG. 2(*b*), the top 210 is formed from a lined fabric 209 formed in a circular shape having a circumference 215 which is generally slightly larger than the corresponding circumference 275 of the explosive device 270 (FIG. 2(*e*)) so that top 210 can cover at least the top of the explosive device 270. Ideally, some additional lined fabric is included, e.g., design for a larger circumference, around the edge of top 210 to enable fastening to the side 212. The lined fabric 209 includes a first liner material 202 which are contained in cells 217. As depicted in FIG. 2(*b*), there are twenty one (21) cells 217 in the lined fabric 209. There is also a gap having no cells in between the group of cells 217 and the edge of the top 210. Although not expressly identified in the figure, the lined fabric 209 also comprises a first and second fabric material (not shown) that sandwich the liner material 202 and a fastener system (not shown) for forming cells in the lined fabric 209. As depicted in FIG. 2(*b*), there are twenty one (21) cells 217 in the lined fabric 209.

FIG. 2(*c*) depicts a plan view of the side of the fragmentation sleeve of FIG. 2(*a*). As seen in FIG. 2(*c*), the side is formed from a lined fabric 208 formed in a rectangular shape having a top edge 227, bottom edge 228, left edge 225, and a right edge 226. The top edge 227 and bottom edge 228 have lengths being equivalent to the circumference 215 of the top 210 and bottom 230. The length of the left edge 225 and right edge 226 are equivalent to the height of the explosive device 270 (FIG. 2(*e*)) so that side 212 can cover the side of the explosive device 270. An additional lined fabric, e.g., design for a larger length and width of lined fabric 208, to enable fastening to the top 210 and the bottom 230. The lined fabric 208 includes a liner material 202 which are contained in cells 222. The lined fabric 208 also comprises a first and second fabric material (not shown) that sandwich the liner material 202 and a fastener system (not shown) for forming cells in the lined fabric 208. As depicted in FIG. 2(*c*), there are one hundred sixty (160) cells 222 in the lined fabric 208. There is also a gap having no cells in between the group of cells 222 and the edges 225, 226, 227, and 228 of the side 212.

FIG. 2(*d*) depicts a plan view of the bottom of the fragmentation sleeve of FIG. 2(*a*). As seen in FIG. 2(*d*), the bottom 230, similar to the top 210, is formed from a lined fabric 213 formed in a circular shape having a circumference 235, which should be comparable to circumference 215, which is generally slightly larger than the corresponding circumference 275 of the explosive device 270 (FIG. 2(*e*)) so that bottom 230 can cover at least the bottom of the explosive device 270. An additional lined fabric, e.g., design for a larger circumference, around the edge of bottom 230 to enable fastening to the side 212. The lined fabric 213 includes a liner material 202 which are contained in cells 231. The lined fabric 213 also comprises a first and second fabric material (not expressly shown) that sandwich the liner material 202 and a fastener system (not expressly shown) for forming cells in the lined fabric 213. As depicted in FIG. 2(*d*), there are twenty one (21) cells 231 in the lined fabric 213. There is also a gap having no cells in between the group of cells 231 and the edge of the bottom 230.

FIG. 2(*e*) depicts, in perspective view, an outline of a cylindrically shaped explosive device 270 having a height of its side 277 and a circumference of its top and bottom being 275.

The fragmentation sleeve 200 is formed by first creating the lined fabric 208, lined fabric 209, and the lined fabric 213. Thus, a first and second fabric material and the liner material for each of the lined fabric 208, lined fabric 209, and the lined fabric 213. For each lined fabric, the first and second fabrics are laid out, the liner material appropriate placed, and the fastener system applied to form the appropriate cells. The lined fabric is then cut to appropriate shape and size. The top 210 is made from lined fabric 209, the bottom 230 is made from lined fabric 213 and side 212 is made from lined fabric 208. Thus, a top 210, a side 212, and bottom 230 have been created.

The fragmentation sleeve 200 is then formed by fastening the right edge 226 to left edge 225 along its length, fastening the circumference 215 of the top to the top edge 227 of the side 212 and fastening the circumference 235 of the bottom 230 to the bottom edge 228 of the side 212. The fragmentation sleeve 200 can be formed around the explosive device 270 well in advance of use. In another approach, the fragmentation sleeve 200 can be partially formed in advance, e.g., leaving the bottom only partially fastened, thus permitting the explosive device 270 to be inserted later and then the bottom fastened (or not). In yet another approach, the fragmentation sleeve 200 is formed in the field, e.g., attaching sides and the tops and bottom using Velcro™ or other quick fastening system, thus permitting the explosive device 270 to be wrapped by the sleeve 200 in the field.

In a preferred approach, the lined fabric 209, the lined fabric 208, and the lined fabric 213 are formed from the same type of first fabric material, second fabric material and first liner material, have the same size cells, and are fastened with the same fastener material, although the invention is not so limited.

In an exemplary application, a fragmentation sleeve was created using automobile headliner material for the lined fabric, steel squares for the liner material and cotton thread (used to sew the material together) as the fastener. If the headliner is made of cotton, then the tensile strength of the material is easily known. The tensile strength of the cotton is generally known to be approximately between 3.0-6.0 g/d.

In another approach, the headliner material is constructed of polyester material layer coupled with a foam backing material layer. Exemplary material specifications for a polyester material layer are provided in Table 1, below, and exemplary specifications for a foam backing material layer are provided below in Table 2. Although an exemplary aspect of the invention is described with respect to using automotive headliner material, the invention is not so limited and any appropriate material can be used.

TABLE 1

| | | |
|---|---|---|
| Material: | Automotive Headliner | |
| Composition: | 100% Polyester | |
| Number of Denier: | 50 | |
| Number of Filaments per yarn: | 24 | |
| Width: | 63"/64" | |
| Weight: | 150 g/Yd | |
| Tensile Strength: | Warp | 18.9 Kg |
| | Fill | 17.6 Kg |
| Tear Strength: | Warp | 2.9 Kg |
| | Fill | 3.2 Kg |
| Elongation: | Warp | 59.70% |
| | Fill | 101.70% |
| Burst Strength: | 12.4 Kg | |
| Flammability: | FMVSS 302 and CAL 117E | |

TABLE 2

| | |
|---|---|
| Material: | Foam backing |
| Composition: | FLEF Polyether Polyurethane |

| | Test Values | |
|---|---|---|
| | Minimum | Average |
| Density | 21.6 ± 10% kg/M$^3$ | 21.6 ± 10% kg/M$^3$ |
| Tensile Strength | 138 kPa | 172 kPa |
| Elongation | 125% | 125% |
| Tear Resistance | 350 N/M | 525 N/M |
| Indentation Force Deflection | | |
| 25% Deflection | 133 N/323 m$^2$ | 178 N/323 m$^2$ |
| 65% Deflection | 245 N/323 m$^2$ | 400 N/323 m$^2$ |
| Retention of Tensile Strength after 5 hours, 120° C., steam autoclave | Min. 70% | Min. 70% |
| Retention of Tensile Strength after 22 hours, 140° C., dry heat aging | Min. 70% | Min. 70% |

The steel squares, from ⅛ inch steel sheets, were chosen as having the desired effect of fragmentation. A preferred size of the squares being ¼ inch by ¼ inch. A preferred size of a cell being ½ inch by ½ inch. The material was selected for the fabric material because it appropriately holds the steel under normal conditions, and because the material does not significantly absorb the kinetic energy from an explosive device thereby permitting most of the blast force to be received by the steel square. Further, the headliner material does not significantly prevent the steel square from being forcefully expelled from the lined fabric as a result of the blast. Low cost, ease of access to raw material, and flexible nature of the material are factors that were also taken into consideration in the selection of the fabric material.

Thus, a fragmentation sleeve has been created from lined fabric. The selection of the exterior materials, the first and second fabric materials, securely carry and provide the liner materials to the explosive device, however, when the explosive device explodes, the fabric materials do not significantly impede the force of the explosive device from reaching the liner material, nor does the fabric materials significantly impede the liner material from being expelled through the fabric material.

The lined fabric, and more specifically the cells of the lined fabric, works as a delivery system for the delivery of liner material, e.g., the steel square. Thus, the selection of the different elements of the lined fabric and the arrangement of those elements should be done with the goal of being a delivery system. For example, if the first fabric layer is too strong or resilient, then it will impede the steel from having its desired effect. Thus, an external kinetic energy force, e.g., from an explosive device, easily passes through a first fabric of the lined fabric towards the liner material, probably rupturing the first fabric, and in turn the external kinetic energy force exerts its energy on the liner material, e.g., the steel square, and the remaining kinetic energy force, as mostly likely delivered through the liner material, ruptures the second fabric and easily passes through the second fabric of the lined fabric. However, without the application of the kinetic energy force, the liner material remains within the lined fabric.

Thus, this example of the invention discloses a lined fabric that has substantially characteristics of a rigid material while maintaining the flexibility and versatility of a fabric. The flexibility of the fabric enabled the lined fabric to be lined around a cylindrically shaped object, e.g., the cylindrically shaped explosive device, and still provide the rigid material, e.g., the liner material being the steel squares.

The selection and arrangement of the elements is dependent on the desired results, availability of materials, or other limitations. For example, if it is desired that the lined fabric 101 is to be washable, then elements are selected appropriate for that goal. For example, a cotton material could be used for fabric material 102 and fabric material 104. For a washable rigid material, a hard plastic or composite material could be used for liner material 103. For a washable fastening material, a cotton thread can be employed.

In a preferred approach, the advantages and disadvantages of each of the elements, viewed both in isolation and in combination, are taken into consideration. For example, in consideration of a first fabric material 102 there is a preferred characteristic of being flexible. In addition or along with that consideration, other various factors might be included, including, but not limited to: cost, availability, flexibility, durability, color, thickness, odor resistance, mildew resistance, water resistance, porous-ness, filtration factors, thermal conductivity, magnetic properties, EMF/radio frequency properties (e.g., conductance, capacitance, transmittance), and flammability. The material choices are almost limitless: for example, cotton, wool, linen, burlap, polyester, spandex, rayon, meshes, netting, and hemp. In an approach, the first fabric material is the same material throughout.

Figure 3A:
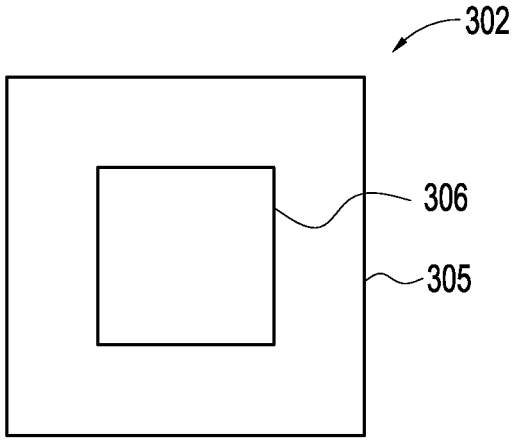
FIGS. 3(*a*)-(*c*) depict fabric material in accordance with alternate aspects of the invention.
Figure 3B:
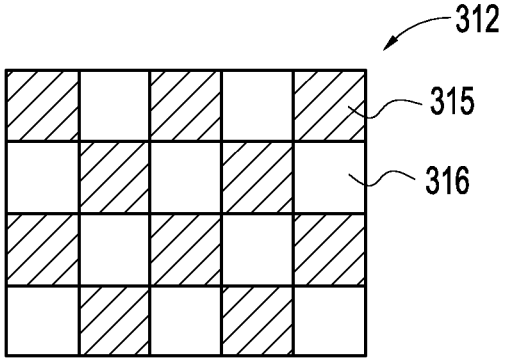
Figure 3C:
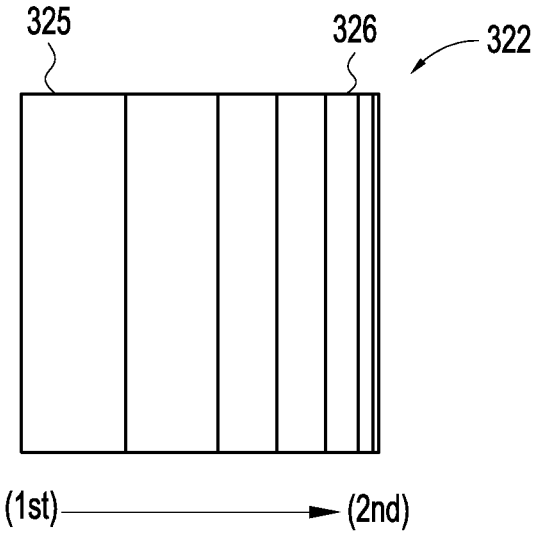

In another approach the first fabric material is a combination of materials. FIGS. 3(*a*)-(*c*) depict representations of alternative formations of fabric materials. For example, as depicted in FIG. 3(*a*) the first fabric material 302 has a first region 305 that is composed a first material, e.g., cotton, and a second region 306 that is composed of a second material, e.g., leather. In another approach, as depicted in FIG. 3(*b*) the first fabric material 312 has a plurality of first regions 315 that are composed a first material, e.g., cotton, and second regions 316 that are composed of a second material, e.g., leather. Although shown in FIG. 3(*b*) as a checkerboard pattern of rectangular regions 315 and 316, the invention is not limited and the arrangement of multiple regions can be in any conceivable approach being of any plurality of materials. In yet another approach, as depicted in FIG. 3(*c*) the first fabric material 322 is comprised of at least two materials 325 and 326, where the fabric material gradually shifts from a first material 325, e.g., on the first side to a second material 326 on the second side. In moving from one side to the other of the first fabric material 322, on the first side the material 322 is substantially composed of the first material 325, on the second side, the material 322 is substantially composed of the second material 326, where in between the first and second side, the material is a mix of the first material 325 and second material 326.

Although the above is described with respect to the first fabric material, the principles apply to second fabric material as well. The selection and arrangement of a fabric used for first fabric material can be the same or different from the fabric used for second fabric material.

The selection of liner material is almost limit-less. In a preferred approach, a liner material is substantially rigid, at least being relatively more rigid than, the fabric layers. In addition or along with that consideration, various other factors are taken into consideration, including, but not limited to: cost, availability, flexibility, durability, color, thickness, odor resistance, mildew resistance, water resistance, porous-ness, filtration factors, thermal conductivity, magnetic properties, EMF/radio frequency properties (e.g., conductance, capacitance, transmittance), and flammability. Design selection may also include consideration of the physical characteristics of the liner material: shape, size, smoothness/roughness, and weight.

The selection of fastening material is almost limit-less. There is a preferred characteristic that the fastening material 107 is substantially, and reliably fastens fabric layer at the desired locations of fabric layer. In addition or along with that consideration, various other factors are considered, including, but not limited to: cost, availability, flexibility, durability, color, thickness, odor resistance, mildew resistance, water resistance, porous-ness, filtration factors, thermal conductivity, magnetic properties, EMF/radio frequency properties (e.g., conductance, capacitance, transmittance), and flammability. The spectrum is extremely wide, for example, from sewing thread to an epoxy to quick fastening materials (e.g., Velcro™).

The assembled lined fabric, having the cells, would be provided in sheets which would be cut and assembled as per a pattern like a traditional fabric.

As noted above, consideration is not only focused on the individual properties of the elements but must also on the combined properties of the elements in light of the desired goal. For example, some liner materials do not work well with certain fasters or alternatively, some fasteners' work better with some liner materials.

Along with the selection of the elements, consideration must be applied to the arrangement of the elements with respect to a desired goal and work within limitations. For example, a decision includes consideration of the characteristics of the lined fabric, which includes the arrangement, organization, and the composition of, e.g., what elements constitute, of the cells.

Figure 4A:
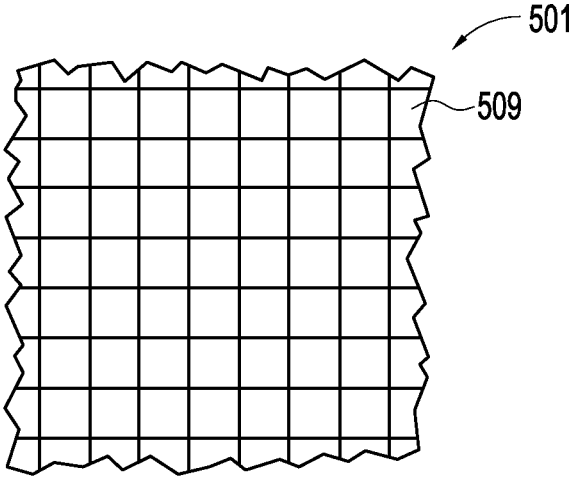
FIGS. 4(*a*)-(*c*) depict cell arrangement in fabric material in accordance with alternate aspects of the invention.
Figure 4B:
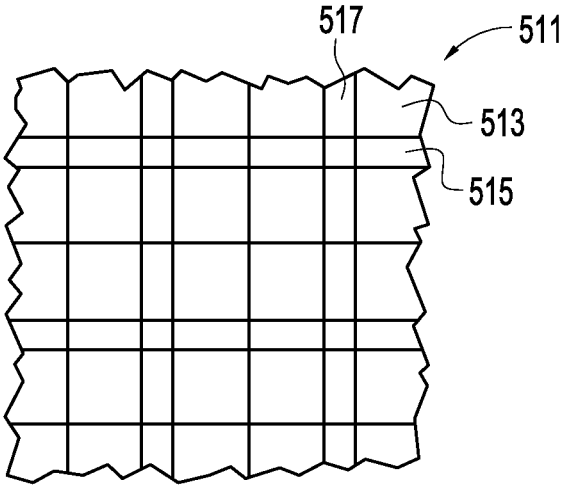
Figure 4C:
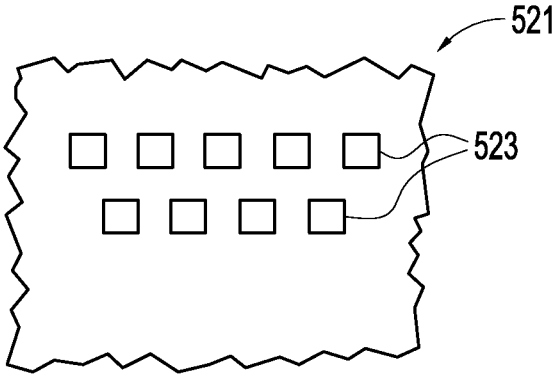

One lined fabric characteristic is whether the arrangement of cells is substantially uniform through the lined fabric, as depicted in FIG. 4(*a*). FIGS. 4(*a*)-(*c*) depict representations of alternative arrangement of cells. In FIG. 4(*a*), the cells 509 in the lined fabric 501 are substantially the same size and shape throughout the lined fabric 501. In FIG. 4(*b*), there is a pattern of cells 513, 515, 517, e.g., cells having the same size and shape at repeating, corresponding locations, throughout the lined fabric 511, although the cells have a plurality of sizes and shapes. In FIG. 4(*c*), cells 523 do not occur through the entire lined fabric 521, but only at certain locations. Additionally, it is important to decide the spacing between cells and within the cells.

Figure 5A:
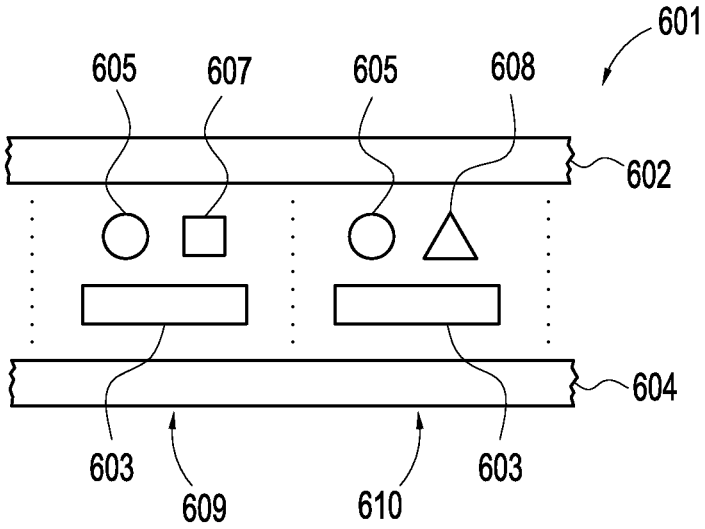
FIGS. 5(*a*)-(*b*) depicts cell composition in fabric material in accordance with alternate aspects of the invention.
Figure 5B:
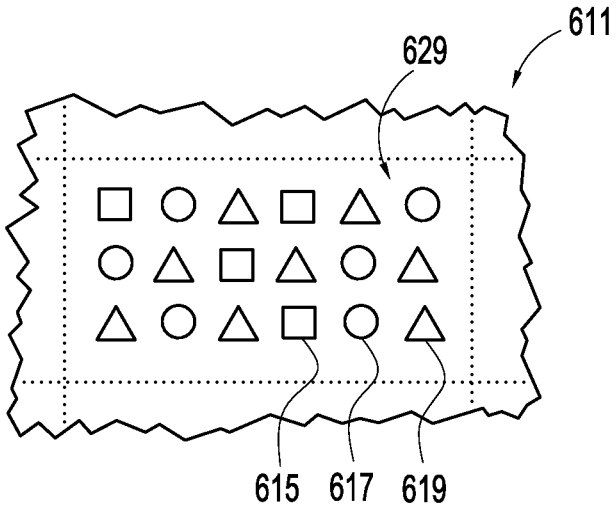
Figure 6A:
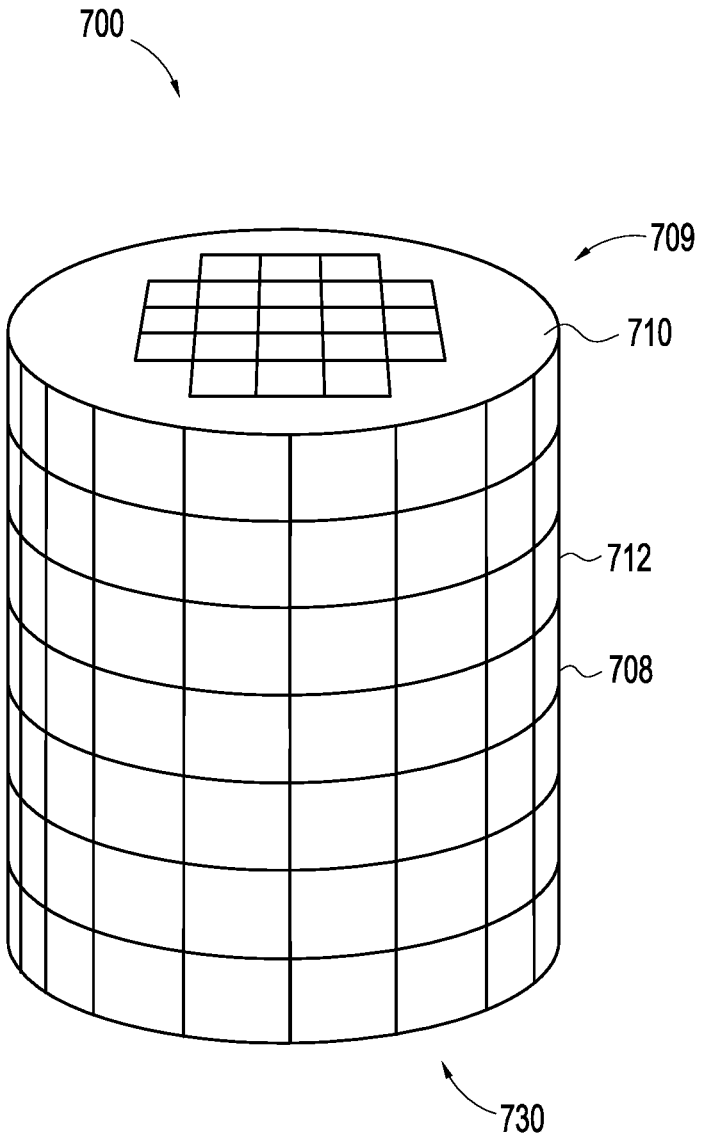
FIG. 6(*a*) depicts another application of the lined fabric in accordance with an exemplary embodiment of the invention.
Figure 6B:
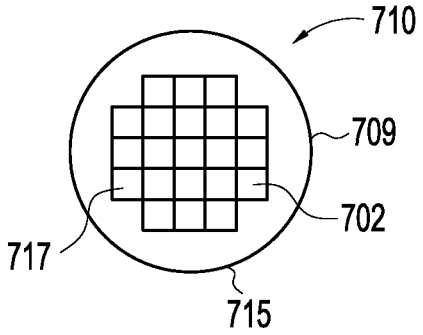
Figure 6C:
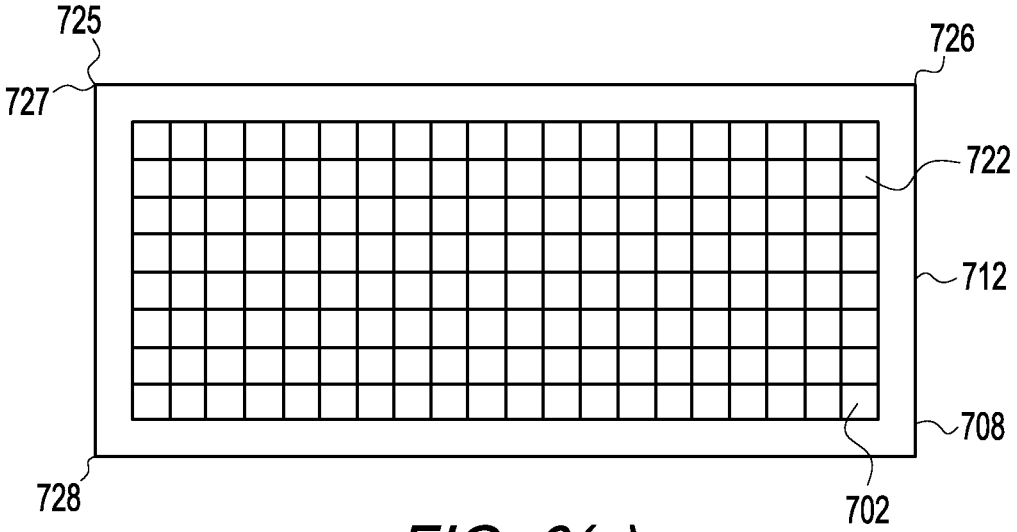
Figure 6D:
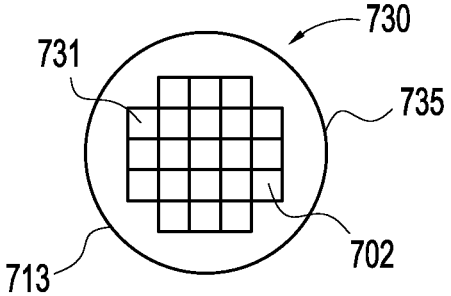
Figure 6E:
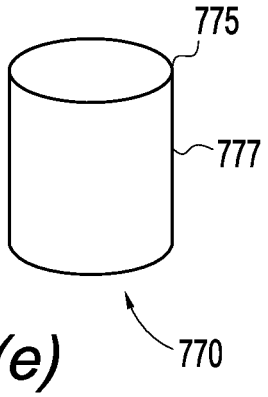

Furthermore, the composition of the cells must also be decided. For example, should all of the cells have substantially the same composition or different composition? FIGS. 5 (*a*)-(*b*) depict representations of alternative exemplary approaches to the selection of cell compositions. In an approach, as described above with reference to FIG. 2, all of the cells have substantially the same composition, e.g., all the cells have steel plates. In another approach as depicted in FIG. 5(*a*), which shows a side view of a lined fabric 601 where the cells have a first lined fabric 602 and a second lined fabric 604 and some of the cells have a first composition and the remainder of the cells have a second composition. For example, cells 609 have steel plate 603, a lead shot 605, and a metal cube 607, and the remainder of the cells a different composition, e.g., the cells 610 have steel plate 603, a lead shot 605, and a metal cone 608.

In yet another approach, at least some of the cells have a plurality of similar or different liner material, e.g., lead shot. See FIG. 5(*b*), which depicts a top view of lined material 611 having a cell 629 which includes a first type of metal shot 615, a second type of metal fragments, 617, and a third type of metal dispersant 619.

In another aspect, the gap around the liner material within the cell can also be varied. The difference in the composition of cells can be based on variety of factors, including but not limited to, location on the fabric. Additionally, in another aspect, the invention discloses, although not depicted, using alternating layers so that the flexibility and rigidity properties better cover the entire area of the fabric. This could be especially advantageous in certain armoring and shielding applications of the fabric.

As noted above, the use of a lined fabric with explosive systems could increase the effectiveness and yield when applied. However, the addition of the fragmentation material in the lined fabric would not be permanent thus providing flexibility in a situation as to whether to apply this lined fabric or not. In this case, a material is desired that is both flexible as a fabric and offer high density, hardness and tensile strength as well as increasing the explosive effect of the kinetic energy force, e.g., ordnance. In this effect, tool steel is selected to be used for the liner material, at the very least, to increase effect of the kinetic energy. In an approach ⅛ tool steel is used for liner material. A cotton blend is selected as a lightweight, inexpensive material that should not detract or minimize the kinetic energy, e.g., the explosive effect. However, application of the invention is only limited by the selection and arrangement of elements.

In an example, a lined fabric can be used for body armor, where the fabric material is selected to minimize ballistic and/or weapon penetration, e.g. Kevlar, and the liner material is selected to minimize ballistic and/or weapon penetration, e.g., ceramic materials, composite materials. Cell arrangement, cell composition, and fastening systems are also chosen to further, or at least not hinder, the goal to minimize ballistic and/or weapon penetration.

In another example, a lined fabric can be used for insulation, where the fabric material is selected to form a weather seal, e.g. Gore-Tex™, and the liner material is selected has insulation properties, e.g., batting, down, polyester. Cell arrangement, cell composition, and fastening systems are also chosen to further, or at least not hinder, the goal to provide insulation.

In an example, a lined fabric can be used for filtration, where the fabric material is selected to allow some level of pourous-ness, e.g. cotton, and the liner material is selected to filter elements, e.g., activated charcoal. Cell arrangement, cell composition, and fastening systems are also chosen to further, or at least not hinder, the goal to provide filtration.

In an example, a lined fabric can be used for electromagnetic shielding, where the fabric material is selected to resist or absorb EMF, e.g. wire mesh, and the liner material is selected to resist or absorb EMF, e.g., graphite composite materials. Cell arrangement, cell composition, and fastening systems are also chosen to further, or at least not hinder, the goal to create an electromagnetic shield.

In an example, a lined fabric can be used for power generation, where the outside facing the solar energy source fabric material is selected to permit transmission of those energy waves, e.g. acetate, and the liner material is selected to collect the solar energy, e.g., solar panels. Cell arrangement, cell composition, and fastening systems are also chosen to further, or at least not hinder, the goal to provide power.

In an example, a lined fabric can be used for flotation, where the fabric material is selected preferably retains little or no water, e.g. large pored nylon, and the liner material is selected to float, e.g., closed cell foam. Cell arrangement, cell composition, and fastening systems are also chosen to further, or at least not hinder, the goal to provide floatation.

In another example, a lined fabric is used for protection of a device. For example, the lined fabric includes shape charges as the liner material, or at least part of the liner material of a lined fabric. In a preferred approach, the shape charges are used to focus a kinetic energy force to one side of the lined fabric. In this approach, a lined fabric can be draped partially over or around or substantially cover an object. The focus of the liner material's kinetic energy is directed to the direction of the material layer closer to the object. When triggered, the force of the kinetic energy in the liner material is substantially directed towards the object and minimal kinetic energy is directed away from the object. Thus, the object is substantially affected by the kinetic energy, but the area surrounding the object is not. Thus, a lined fabric can be used as a force contained blast. In another approach, the lined fabric is used a theft deterrent system, such that when theft of a device, which is at least partially covered by the lined fabric, is attempted, the shaped charges are triggered, ideally destroying the covered object, and as a result, thwarting the theft of the object.

For example, in reference with FIGS. 2(*a*)-(*e*), where the fragmentation sleeve 200 is in this example a source of a kinetic energy instead of a fragmentation sleeve and the explosive device 270 is an object sought to be destroyed instead of a source of kinetic energy. Thus, the constituent parts of the cover are different. In this approach, a cover 200 is placed over an object 270 to be, at least, partially, damaged or destroyed. The liner material used in the cover 200, e.g., the liner material in the lined fabric 209, the lined fabric 208, and the lined fabric 213, is a shaped kinetic energy source, e.g., a shaped charge. The liner material oriented such that the force of the kinetic energy, when activated by an appropriate mechanism (not shown), is directed to the interior space of the cover 200, whereby the object 270 covered is at least partially damaged. Activation mechanism can be any conventional mechanism.

Although this application is described with reference to a cylindrically shaped cover and object being covered, the invention is not so limited. For example, the cover can be substantially rectangularly shaped, e.g., a blanket, and placed over at least part of an object, where the object may or may not be rectangularly shaped.

Different from the invention described above with respect to a fragmentation cover, when a lined fabric is used as source of kinetic energy, as is conventionally known, it may be necessary to couple, e.g., electronically, the liner material, for the purposes of triggering. This can be accomplished by any appropriate conventionally known approach.

FIG. 6(*a*) depicts an application of the lined fabric, as an augmentation sleeve, in accordance with another exemplary embodiment of the invention. A lined fabric is used for supplementing or augmenting a device intended on controlling the behavior of a person(s) or animals, e.g., crowd or pet control. FIG. 6(*a*) shows, in a perspective line drawing, a lined fabric used as an augmentation sleeve 700 for use with a source of strong, but typically non-lethal, kinetic energy, e.g., a small load concussive grenade, a stun or flash bang grenade/explosive, or a gas generation system. These sources are trigger either automatically or manually, by a variety of known triggering system.

The augmentation sleeve is placed on/over an explosive device, with the second fabric material being in contact with the explosive device. When the explosive device explodes the force of the explosion is carried through the backside of the augmentation sleeve, through the second fabric material to the lined material and the lined material is expelled from the lined material, most likely by rupturing and passing through the first fabric material. Thus, a goal of the fabric is to have the liner material be expelled from the augmentation sleeve, where the augmentation sleeve is secure enough to maintain the liner material, but not too secure such that fabric does not significantly affect kinetic energy being received by the liner material, and such that it does not significantly affect the liner material from rupturing the augmentation sleeve and being expelled through it.

A liner material is selected dependant on the desired result. The shape and other characteristics of the liner material is selected dependant on the desired result; the shape and/or other characteristics may increase or decrease a desired effect, e.g., a rounded shape reduces the likelihood of serious injury. These combinations of features, and other features, are also referred to as an injury reduction feature. For example, in one approach, steel squares are selected with specific design feature, e.g., rounded edges, to reduce the likelihood of serious injury from bodily contact, made from one eighth (⅛) inch sheet steel, cut in one-quarter (¼) inch pieces are used as liner material and are imbedded in a lightweight fabric; one steel square in each cell. In another approach, dense yet flexible augmentation piece is used instead of sheet steel. For example, rubber, tungsten impregnated rubber, or plastic squares are used, instead of the sheet steel as the liner material; rubber or plastic balls or pellets are also alternatives. In yet another approach, the liner material is, or includes, a gel or coating as an ablative or force spreading feature to spread out impact across an intended target's body. In an approach, a single piece of liner material is selected to be placed in a cell. In yet another approach, a plurality of pieces of liner material is placed in a cell, where the pieces may be similar or different in material, shape, and size. As is known, hard rubber has a density of $1.2\times10^3$ kg/m$^3$.

As described with respect to FIGS. 6(*a*)-(*e*), the non-lethal explosive device is substantially cylindrically shaped, but not necessarily so limited. Thus, it should be determined how best to wrap the device in a cover with the augmentation sleeve. The shape of the cover would likely be broken into constituent parts. As the device is shaped like a cylinder, it is reasonable to fashion an augmentation sleeve to cover a device by making a top, bottom, and side, where the top and bottom are circular and substantially the same, and the side is substantially rectangular. The lined fabric is fashioned into a cover, e.g., a augmentation sleeve 700, appearing to be a cylindrical object as seen in FIG. 6(*a*) The augmentation sleeve 700 has a top 710, a bottom 730 (not seen in this view), and side 712. The top 710 of the augmentation sleeve 700 is formed from a first lined fabric 709. The side 712 of the augmentation sleeve 700 is formed from a second lined fabric 708.

FIG. 6(*b*) depicts a plan view of the top of the augmentation sleeve of FIG. 6(*a*). As seen in FIG. 6(*b*), the top 710 is formed from a lined fabric 709 formed in a circular shape having a circumference 715 which is generally slightly larger than the corresponding circumference 775 of the explosive device 770 (FIG. 6(*e*)) so that top 710 can cover at least the top of the explosive device 770. It is preferable to include some additional lined fabric, e.g., design for a larger circumference, around the edge of top 710 to enable fastening to the side 712. The lined fabric 709 includes a first liner material 702 which are contained in cells 717. As depicted in FIG. 6(*b*), there are twenty one (21) cells 717 in the lined fabric 709. There is also a gap having no cells in between the group of cells 717 and the edge of the top 710. Although not expressly identified in the figure, the lined fabric 709 also comprises a first and second fabric material (not shown) that sandwich the liner material 702 and a fastener system (not shown) for forming cells in the lined fabric 709. As depicted in FIG. 6(*b*), there are twenty one (21) cells 717 in the lined fabric 709. There is also a gap having no cells in between the group of cells 717 and the edge of the top 710.

FIG. 6(*c*) depicts a plan view of the side of the augmentation sleeve of FIG. 6(*a*). As seen in FIG. 6(*c*), the side is formed from a lined fabric 708 formed in a rectangular shape having a top edge 727, bottom edge 728, left edge 725, and a right edge 726. The top edge 727 and bottom edge 728 have lengths being equivalent to the circumference 715 of the top 710 and bottom 730. The length of the left edge 725 and right edge 726 are equivalent to the height of the explosive device 770 (FIG. 6(*e*)) so that side 712 can cover the side of the explosive device 770. Ideally, additional lined fabric is included, e.g., design for a larger length and width of lined fabric 708, to enable fastening to the top 710 and the bottom 730. The lined fabric 708 includes a liner material 702 which are contained in cells 722. The lined fabric 708 also comprises a first and second fabric material (not shown) that sandwich the liner material 702 and a fastener system (not shown) for forming cells in the lined fabric 708. As depicted in FIG. 6(*c*), there are one hundred sixty (160) cells 722 in the lined fabric 708. There is also a gap having no cells in between the group of cells 722 and the edges 725, 726, 727, and 728 of the side 712.

FIG. 6(*d*) depicts a plan view of the bottom of the augmentation sleeve of FIG. 6(*a*). As seen in FIG. 6(*d*), the bottom 730, similar to the top 710, is formed from a lined fabric 713 formed in a circular shape having a circumference 735, which should be comparable to circumference 715, which is generally slightly larger than the corresponding circumference 775 of the explosive device 770 (FIG. 6(*e*)) so that bottom 730 can cover at least the bottom of the explosive device 770. Ideally some additional lined fabric is included, e.g., design for a larger circumference, around the edge of bottom 730 to enable fastening to the side 712. The lined fabric 713 includes a liner material 702 which are contained in cells 731. The lined fabric 713 also comprises a first and second fabric material (not expressly shown) that sandwich the liner material 702 and a fastener system (not expressly shown) for forming cells in the lined fabric 713. As depicted in FIG. 6(*d*), there are twenty one (21) cells 731 in the lined fabric 713. There is also a gap having no cells in between the group of cells 731 and the edge of the bottom 730.

FIG. 6(*e*) depicts, in perspective view, an outline of a cylindrically shaped explosive device 770 having a height of its side 777 and a circumference of its top and bottom being 775.

The augmentation sleeve 700 is formed by first creating the lined fabric 708, lined fabric 709, and the lined fabric 713. Thus, first and second fabric material and the liner material for each of the lined fabric 708, lined fabric 709, and the lined fabric 713 are selected. For each lined fabric, the first and second fabrics are laid out, the liner material appropriate placed, and the fastener system applied to form the appropriate cells. The lined fabric is then cut to appropriate shape and size. The top 710 is made from lined fabric 709, the bottom 730 is made from lined fabric 713 and side 712 is made from lined fabric 708. Thus, a top 710, a side 712, and bottom 730 have been created.

The augmentation sleeve 700 is then formed by fastening the right edge 726 to left edge 725 along its length, fastening the edge 715 of the top to the top edge 727 of the side 712 and the fastening the edge 735 of the bottom 730 to the bottom edge 728 of the side 712. The augmentation sleeve 700 can be formed around the explosive device 700 well in advance of use. In another approach, the augmentation sleeve 700 can be partially formed in advance, e.g., leaving the bottom only partially fastened, thus permitting the explosive device 770 to be inserted later and then the bottom fastened (or not). In yet another approach, the augmentation sleeve 700 is formed in the field, e.g., attaching sides and the tops and bottom using Velcro™ or other quick fastening system, thus permitting the explosive device 770 to be wrapped by the sleeve 700 in the field.

In a preferred approach, the lined fabric 709, the lined fabric 708, and the lined fabric 713 are formed from the same type of first fabric material, second fabric material and first liner material, have the same size cells, and are fastened with the same fastener material, although the invention is not so limited.

When using the augmentation sleeve with a flash bang type explosive device, as with any other kinetic device, the design and selection of an augmentation device should consider the direction/vector of the force generated by the explosive device. For example, a standard explosive device emanates force that is substantially normal to the exterior surface of the explosive device and the force is delivered from substantially over the entire device. Flash bang devices generally operate differently. In an approach, when detonated, the body of the explosive device remains intact. The body of the explosive device is tube-shaped with apertures along the sides that emit the light, sound, and any concussion force of the explosion. Thus, the explosive force of device is on delivered from certain locations. In a preferred approach, an augmentation sleeve used with a flash bang device has the plurality of cells containing the liner material that substantially coincide with the line up with the apertures of the flash bang.

In an exemplary application, an augmentation sleeve was created using automobile headliner material for the lined fabric, steel squares for the liner material and cotton thread (used to sew the material together) as the fastener. The ⅛ inch steel squares were chosen as having the desired effect of augmentation. A preferred size of the squares being ¼ inch by ¼ inch. A preferred size of a cell being ½ inch by ½ inch. The headliner material was selected for the fabric material because it appropriately holds the steel under normal conditions, and because headliner does not significantly absorb the kinetic energy from an explosive device thereby permitting most of the blast force to be received by the steel square. Further, the headliner material does not significantly prevent the steel square from being forcefully expelled from the lined fabric as a result of the blast. Low cost, ease of access to raw material, and flexible nature of the material are factors that were also taken into consideration in the selection of the fabric material.

In a preferred approach, a cloth mesh/netting is used as the fabric material. The cloth mesh is strong enough to retain the liner material until the kinetic energy source is detonated, but not too strong that the cloth mesh does not significantly impede the transmission of the pyrotechnics and/or the sound, e.g., the acoustic pulse, generated by the kinetic energy source.

Thus, an augmentation sleeve has been created from lined fabric. In this situation, the selection of the exterior materials, the first and second fabric materials, securely carry and provide the liner materials to the kinetic energy source, however, when the kinetic energy source is detonated, the fabric materials do not significantly impede the force of the explosive device from reaching the liner material, nor does the fabric materials significantly impede the liner material from being expelled through the fabric material.

The lined fabric, and more specifically the cells of the lined fabric, works as a delivery system for the delivery of liner material, e.g., the steel square. Thus, the selection of the different elements of the lined fabric and the arrangement of those elements should be done with the goal of being a delivery system. The selection and arrangement of the elements is dependent on the desired results, availability of materials, or other limitations. In a preferred approach, the advantages and disadvantages of each of the elements of the lined fabric are considered, viewed both in isolation and in combination.

Thus, this example of the invention discloses a lined fabric that has substantially characteristics of a rigid material while maintaining the flexibility and versatility of a fabric. The flexibility of the fabric enabled the lined fabric to cover a cylindrically shaped object, e.g., the cylindrically shaped explosive device, and still provide the rigid material, e.g., the liner material being the steel squares. An advantage of the augmentation sleeve is that a decision is made, in the field, the type of augmentation desired, if any, and selects an appropriate augmentation sleeve that should satisfy the intended results with a selected kinetic energy source. For example, for crowd control, a lined fabric is selected having liner material comprised of hard rubber balls (e.g., for reducing injury on target impact), liner fabric comprised of a cloth mesh (e.g., to retain the liner material until the kinetic energy of the kinetic energy source occurs, but not to significantly hinder the transmission of pyrotechnics), and a flash bang device as a kinetic energy source.

In another approach, liner material is chosen to provide an additional flash and/or bang. For example, additional pyrotechnic material is used as liner material, preferably encapsulated, in a lined fabric used to fashion an augmentation sleeve. When it is decided in context of a situation that additional flash is required in addition to the standard flash of a flash bang, an augmentation sleeve is attached having additional pyrotechnic material and then deploys the combined device. Similarly, in context, it is decided that additional "bang" is required, and therefore an augmentation sleeve is attached having additional sound producing material to augment the acoustic pulse and then deploys the combined device. Liner material can also be used to deliver other issues as well, including, but not limited to tear gas. In alternative, the augmentation sleeve is designed to be detonated in advance or behind the explosive device. Thus, for example, creating a second flash or bang.

In yet another approach, there is a desired effect of having a marking substance that will mark, e.g., with paint or some other approach, individuals and/or things within range of the explosive device when detonated. This desired effect is helpful for law enforcement purposes and litigation/injury analysis later. For example, an augmentation device includes paint or ink pellets as liner material in the lined fabric of an augmentation sleeve. The pellets can also be used in conjunction with other liner material in the lined fabric.

Depending on the selection and arrangement of lined fabric and its constituent parts used in an augmentation sleeve, it is important to consider the storage, movement and implementation of the augmentation sleeve. For example, a liner material or lined fabric is sensitive to its environment, e.g. heat, sparks, etc., thus requiring careful storage. The storage may be, for example, a temperature and/or humidity controlled environment. The storage may also include electrostatic discharge precautions.

In another aspect, an augmentation sleeve is designed with an injury reduction feature. For example, an augmentation sleeve incorporates a trajectory control feature, which may be structural features such as a base or design of the sleeve or positioning of the sleeve relative to the gas generator or explosive device e.g., flash bang, which directs the fragments no higher than the average person's chest—avoiding head and eye injuries.

In another approach, a base structure, e.g., a foam insert/body or other semi-rigid or rigid material insert/body, is used in which an explosive device, for example, a gas generator, is inserted which helps position an augmentation sleeve. For example, as depicted with respect to FIG. 7(*a*), a base structure 810 is created in the form of a conic section. An augmentation sleeve 820 is created which covers the base structure 810. The augmentation sleeve 820 is formed from lined fabric having a plurality of cells, each containing a liner material. An explosive source 830—a gas generator e.g., explosive or flash bang, is inserted into an opening of the base structure 810. The base structure 810 has ducts 812, e.g., apertures, at designated locations to direct high speed gas resulting from the detonation of the explosive source 830 to preferred, corresponding locations of cells 822 on the augmentation sleeve 820. Thus, high speed gas is directed to porting through apertures 822 at specific locations on the augmentation sleeve 820, which, in a preferred approach, results in a targeted application of cells of an augmentation sleeve. The explosive device can be triggered by trigger 845 in any conventionally known method, either manually or automatically, e.g. a movement sensor, physical trip wire, or wireless system.

Figure 7B:
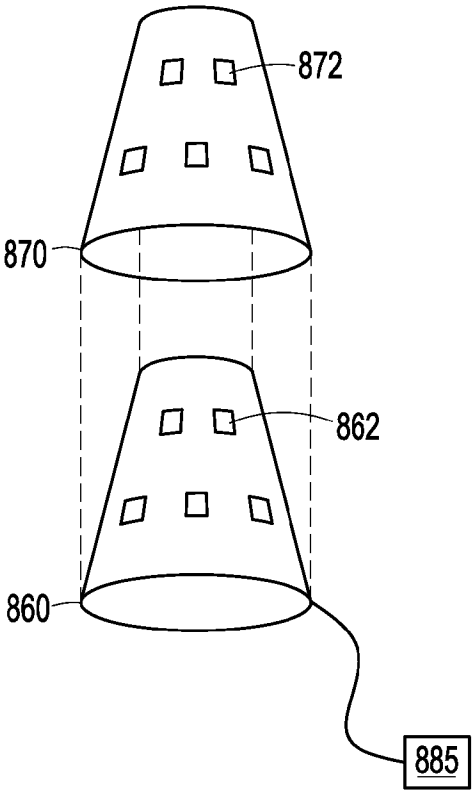
FIGS. 7(*a*)-(*b*) depict implementations of the lined fabric.
Figure 7A:
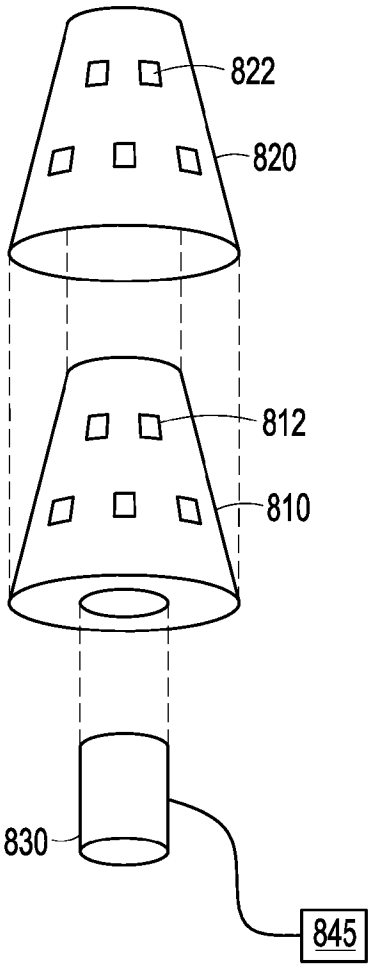
Figure 8:
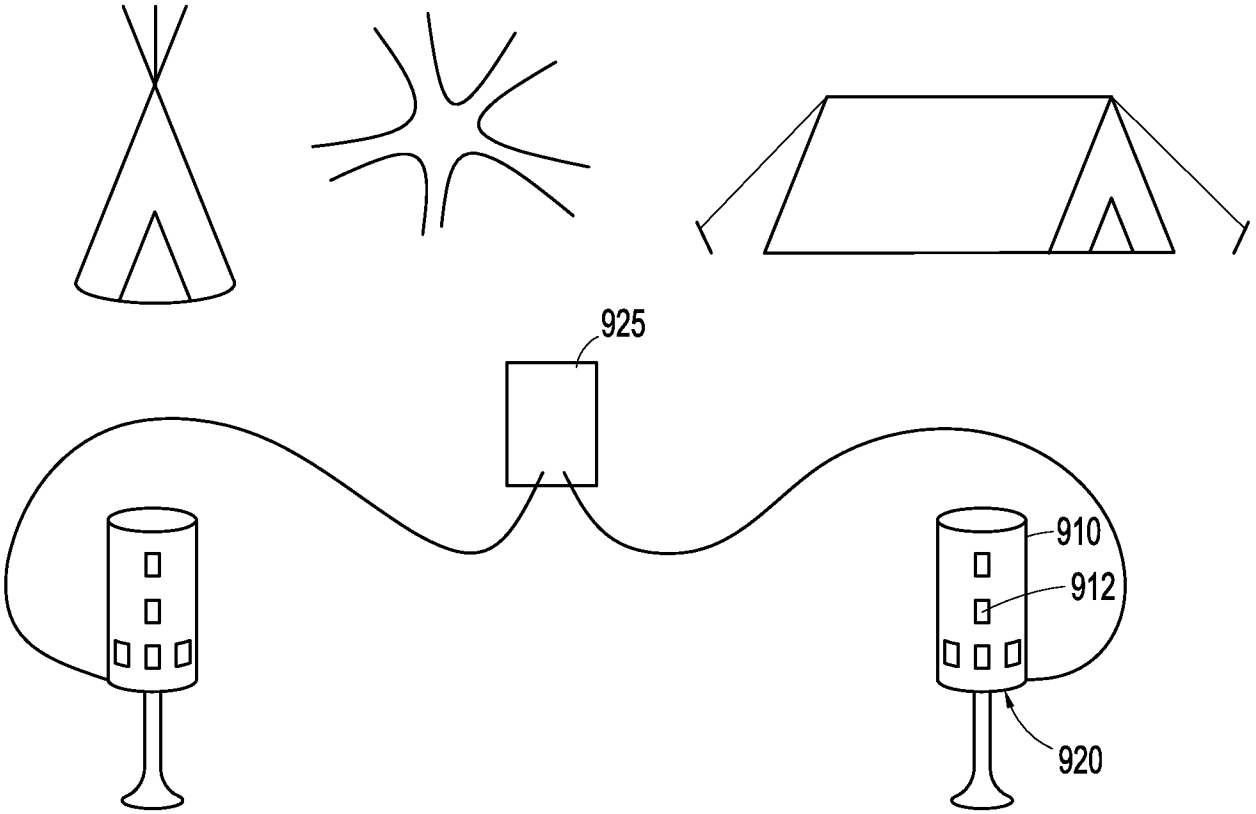
FIG. 8 depicts another implementation of the lined fabric.

In another approach, as depicted with respect to FIG. 7(*b*), an explosive device has ducts which direct high speed gas to preferred locations on an augmentation sleeve. For example, a base structure 860 is an explosive device in this exemplary approach, created in the form of a conic section. An augmentation sleeve 870 is created which covers the base structure 860. The augmentation sleeve 870 is formed from lined fabric having a plurality of cells, each containing a liner material. The base structure 860 has ducts 862, e.g., apertures, at designated locations to direct high speed gas resulting from the detonation of the explosive source to preferred, corresponding locations of cells 872 on the augmentation sleeve 870. Thus, high speed gas is directed to porting at specific locations on the augmentation sleeve 870, which, in a preferred approach, results in a targeted application of cells of an augmentation sleeve. The explosive device can be triggered by trigger 885 in any conventionally known method, either manually or automatically, e.g. a movement sensor, physical trip wire, or wireless system In yet another application as depicted with respect to FIG. 8, an augmentation sleeve 910 placed over an explosive device 920 is used for repelling, for example, wild animals or pirates. For example, a liner material is selected to increase the likelihood of deterring a wild animal, which, most likely, would be different than for human targets. For example, heavy, large rubber balls are selected for liner material. The augmentation sleeve fashioned with the selected liner material covers an explosive device, which is then strategically placed, for example, at the entrance of a camp. In a preferred approach, the lined fabric is fashioned to create a targeted approach; such that the resulting augmentation sleeve has cells 912 with liner material only in a portion of the augmentation sleeve. Thus, liner material is expelled only in a certain direction(s). The explosive device has an appropriate trigger mechanism 925 for the explosive device. The trigger is, for example, done manually or by a pressure switch. In another approach, the trigger is done by trip wires. In yet another approach, the trigger is done by response to movement within a certain distance. In yet another approach, an infrared trigger is employed, which is programmable to detect thermal profiles which can be used to match humans versus bears, etc. Different profiles can be used to initiate a different threat response—e.g., human—only at knee level or lower, bear—up to four feet, etc. Although only depicted as the devices are placed at an entrance to camp, the invention is not so limited, as the devices can be placed in any preferred arrangement, around a portion or the entirety of the perimeter of a camp site. Detonation occurs in any preferred arrangement, e.g., singularly, or in a group or groups.

Figure 9:
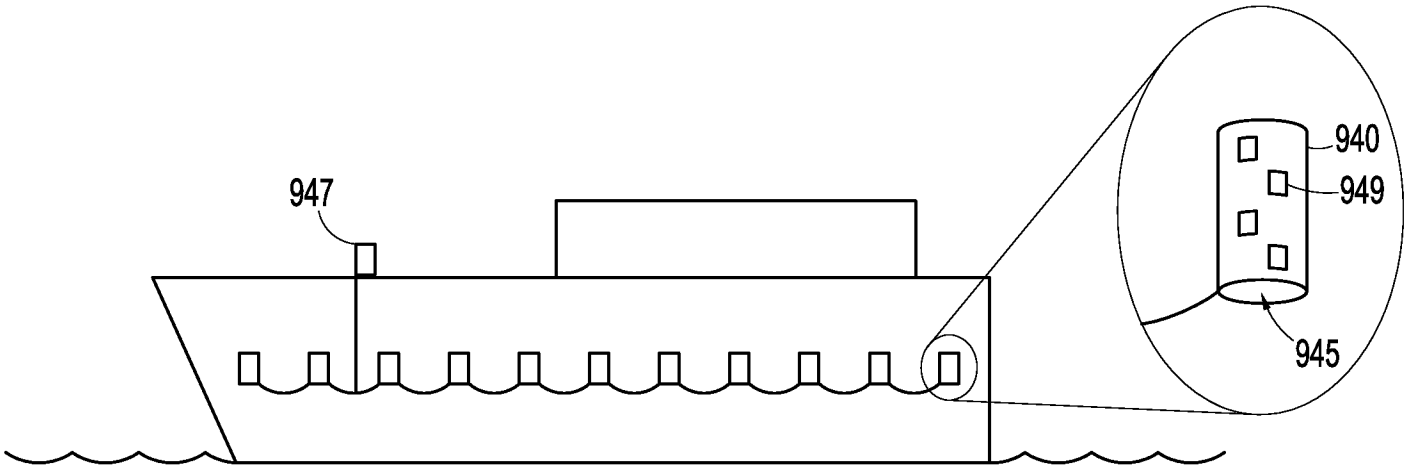
FIG. 9 depicts yet another implementation of the lined fabric.

With respect to repelling the trespass of unwanted visitors/boarders at sea, e.g., pirates, augmentation sleeves 940 covering explosive devices 945 are connected partially or substantially around the perimeter of a ship, as depicted in FIG. 9. The explosive devices are preferably coupled together and triggered by a trigger device 947, automatically or manually, singularly, or in a group or groups, when pirates approach a ship and/or attempt to board a ship. In this application, the augmentation sleeve has a targeted design of cells 949 of lined material. It is obviously important to position the augmentation correctly, e.g., such that the augmentation sleeve expels the liner material away from the host boat towards the would-be trespassers. In an approach, the desired trajectory of the different augmentation sleeves is coordinated between the placement and arrangement of the different sleeves, and the cells on the augmentation sleeves to have a desired target trajectory or trajectories.

In an approach, the augmentation sleeve is considered to have two parts or "sides," which together form the entire sleeve. Although referred to as a side, the name is not limiting to a specific location, size, or portion of the augmentation sleeve. A first side contains a liner material that is to be expelled upon detonation of an associated explosive device. This is the side that is generally directed towards the location of potential trespassers or other unwanted guests. A second side is comprises a fabric material and/or liner material that reduces the force of the exploded explosive device; thus, limiting an explosive force in that direction. The second side is generally directed towards the location of wanted guests and hosts.

In yet another approach to discouraging pirates, augmentation sleeves are employed over explosive devices, which in turn are fastened to a curtain, e.g., netting. The explosive embedded curtain can be fired/dragged over a pirate ship and then selectively detonated.

Figure 10:
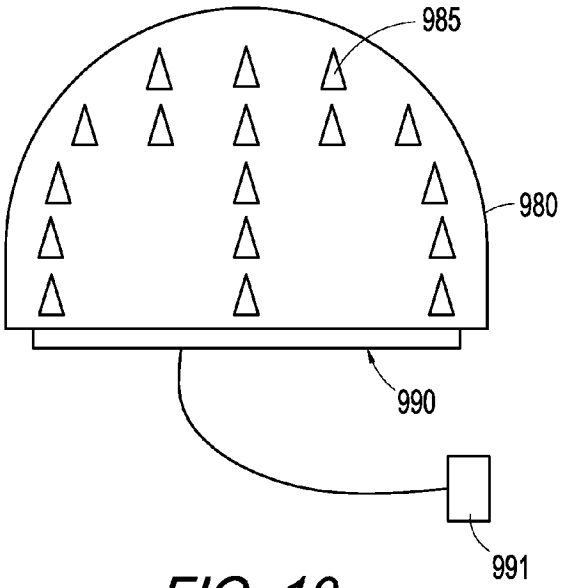
FIG. 10 depicts yet another implementation of the lined fabric.

In yet another application as depicted with respect to FIG. 10, augmentation sleeves 980 are employed to augment explosives 990 deployed in an oil well. In this case, an augmentation sleeve having targeted arrangement of cells 985 having lined material, e.g., additional explosive material, around another charge is helpful. Especially because it provides rapid insertion. In an approach, an augmentation sleeve is used, e.g., in a curtain approach—wrapped around a cylinder with edges on the end to protect the lined fabric, to add a protective layer to protect the charges from the environment e.g., drilling mud, etc. The device 990 is triggered by any conventional trigger device 991.

In a further application, an augmentation sleeve uses a charge carrying device as liner material. For example, a liner material is a charged capacitor or electrical prongs coupled by long (e.g., two to four meters) wires to a charge source; the long wires are included in the pocket of the lined fabric with the liner material. The charge source is, for example, contained in the augmentation sleeve and coupled to the wires of respective charge carrying devices in the augmentation sleeve, thus providing a source of electric energy when desired. Thus, in an application, an augmentation sleeve is placed over a source of kinetic energy, such as a stun grenade, and when the grenade is detonated, the charge carrying liner material is projected in proximity to the stun grenade. If a person is within the proximity at that time, then the charge carrying liner material contacts the person and preferably maintains contact with the person. Shortly thereafter or contemporaneously with the contact, the electric energy source provides an electric charge through the wires, through the charge carrying liner material to the person and thus the person receives an electric shock. The specific attributes of the charge carrying liner material, the wires, and the electric energy source are variable and should be selected with its desired results in mind.

While the invention has been described and illustrated with reference to specific exemplary embodiments, it should be understood that many modifications and substitutions can be made without departing from the spirit and scope of the invention. For example, various combinations of the above examples, although expressly disclosed, can be made without departing from the spirit and scope of the invention. For example, although the discussion above describes certain types of explosive devices, the invention is not so limited, and augmentation sleeves can be used, possibly with appropriate modifications to the augmentation, with many explosive devices. For example, an augmentation device is used with a depth charge. Accordingly, the invention is not to be considered as limited by the foregoing description but is only limited by the scope of the claims.

What is claimed is:

1. An augmentation device comprising:

a kinetic force apparatus adapted to produce a first effect comprising a first kinetic force above a second kinetic force, said kinetic force apparatus comprises an explosive device that generates said first effect comprising a gas vented in a plurality of directions away from said kinetic force apparatus;

an augmentation apparatus adapted to produce a second effect, said augmentation apparatus comprising an enclosing structure comprising a first flexible layer, a second flexible layer, said enclosing structure having a fastener, an opening in said enclosing structure formed with a wall structure, wherein said enclosing structure further comprises a moveable cover adapted to selectively couple said moveable cover with a section of said wall structure, said enclosing structure is adapted to receive and selectively retain and release said kinetic force apparatus such that said enclosing structure conforms to at least one side of said kinetic force apparatus and in physical contact with at least one side of said kinetic force apparatus, said enclosing structure further comprises a plurality of cells formed into the first and second layers, wherein said plurality of cells are adapted to retain a plurality of third layers respectively within each of said cells in a first position relative to said kinetic force apparatus when a force up to at least said second kinetic force impinges upon said first and second layers, wherein, said first layer, said second layer, and said plurality of cells are adapted to release said plurality of third layers when said first kinetic force impinges upon said first and second layers when said kinetic force apparatus is detonated and substantially tears at least said first layer, where said first kinetic force is greater than a tensile strength of said first and second layers, wherein said first and second layers have a respective first and second material property adapted to provide substantial resistance to abrasion and loss of integrity, and wherein said third layer comprises a material and shape selected such that said third layer substantially retains structural integrity and absorbs said first kinetic force and retains a level of kinetic energy above a second kinetic force sufficient to substantially produce an impact or damage event within a predetermined radius from said kinetic force apparatus when said kinetic force apparatus is detonated.

2. The augmentation device of claim 1, wherein said kinetic force apparatus is adapted to produce said first effect without producing fragmentation objects from said kinetic force apparatus.

3. The augmentation device of claim 1, wherein said kinetic force apparatus is adapted to produce said first effect in addition to producing fragmentation objects from said kinetic force apparatus.

4. The augmentation device as in claim 1, wherein said third layer includes a means for injury reduction.

5. The augmentation device as in claim 4, wherein said means for injury reduction of said third layer comprises a section of said third layer having at least one rounded edge.

6. The augmentation device as in claim 4, wherein said means for injury reduction of said third layer comprises said section of said third layer having an at least slightly flexible material.

7. The augmentation device as in claim 4, wherein said means for injury reduction of said third layer comprises said section of said third layer substantially from rubber.

8. The augmentation device as in claim 6 wherein said flexible material comprises magnesium impregnated rubber formed with at least one rounded edge.

9. The augmentation device as in claim 1, wherein said third layer comprises a metal plate.

10. The augmentation device as in claim 9, wherein said metal plate comprises steel.

11. An augmentation device as in claim 4, wherein said means for injury reduction of said third layer comprises flexible material having a density substantially equivalent or greater than 1×103 kg/m3.

12. An augmentation device comprising:

a kinetic force apparatus adapted to produce a first effect comprising a first kinetic force above a second kinetic force, said kinetic force apparatus comprises an explosive device that generates said first effect comprising a gas vented in a plurality of directions away from said kinetic force apparatus;

an augmentation apparatus adapted to produce a second effect, said augmentation apparatus comprising an enclosing structure comprising a first flexible layer, a second flexible layer, said enclosing structure having a fastener, an opening in said enclosing structure formed with a wall structure, wherein said enclosing structure further comprises a moveable cover adapted to selectively couple said moveable cover with a section of said wall structure, said enclosing structure is adapted to receive and selectively retain and release said kinetic force apparatus such that said enclosing structure conforms to at least one side of said kinetic force apparatus and in physical contact with at least one side of said kinetic force apparatus;

said enclosing structure further comprises a plurality of cells formed into the first and second layers, wherein said plurality of cells are adapted to retain a plurality of third layers respectively within each of said cells in a first position relative to said kinetic force apparatus when a force up to at least said second kinetic force impinges upon said first and second layers, wherein, said first layer, said second layer, and said plurality of cells are adapted to release said plurality of third layers when said first kinetic force impinges upon said first and second layers when said kinetic force apparatus is detonated and thereby substantially consumes at least said first layer, where said first kinetic force is greater than a tensile strength of said first and second layers, wherein said first and second layers have a respective first and second material property adapted to provide substantial resistance to abrasion and loss of integrity, and wherein said third layer comprises a material and shape selected such that said third layer substantially retains structural integrity and absorbs said first kinetic force and retains a level of kinetic energy above a second kinetic force sufficient to substantially produce an impact or damage event within a predetermined radius from said kinetic force apparatus when said kinetic force apparatus is detonated.

13. The augmentation device of claim 12, wherein said kinetic force apparatus is adapted to produce said first effect without producing fragmentation objects from said kinetic force apparatus.

14. The augmentation device of claim 12, wherein said kinetic force apparatus is adapted to produce said first effect in addition to producing fragmentation objects from said kinetic force apparatus.

15. The augmentation device as in claim 12, wherein said third layer includes a means for injury reduction.

16. The augmentation device as in claim 15, wherein said means for injury reduction comprises at least one section of said third layer having at least one rounded edge.

17. The augmentation device as in claim 15, wherein said means for injury reduction comprises said third layer including a flexible material adapted to deform and thereby dissipate kinetic force upon impact having a density substantially equivalent to or greater than 1×103 kg/m3.

18. The augmentation device as in claim 16, wherein said means for injury reduction comprises forming said third layer substantially from rubber.

19. The augmentation device as in claim 17, wherein said flexible material comprises magnesium impregnated rubber formed with at least one rounded edge.

20. The augmentation device as in claim 12, wherein said third layer comprises a metal plate.

21. The augmentation device as in claim 20, wherein said metal plate comprises steel.

22. An augmentation device as in claim 15, wherein said means for injury reduction comprises said third layer having a somewhat flexible material having a density substantially equivalent to or greater than 1×103 kg/m3.

23. An augmentation device comprising:

a kinetic force apparatus comprising an explosive device operable to generate a first effect, said first effect comprising an explosively generated gas wave directed away from said kinetic force apparatus;

an augmentation apparatus adapted to produce a second effect, said augmentation apparatus comprising an enclosing structure comprising a first flexible layer, a second flexible layer, said enclosing structure having a fastener, an opening in said enclosing structure formed with a wall structure, wherein said enclosing structure further comprises a moveable cover adapted to selectively couple said moveable cover with a section of said wall structure, said enclosing structure is adapted to receive and selectively retain and release said kinetic force apparatus such that said enclosing structure conforms to at least one side of a kinetic force apparatus and being adapted to being in physical contact with at least one side of said kinetic force apparatus, said augmentation apparatus being adapted to receive said first effect produced by the kinetic force apparatus comprising said first kinetic force above a second kinetic force, said enclosing structure further comprises a plurality of cells formed into the first and second layers, wherein said plurality of cells are adapted to retain a plurality of third layers respectively within each of said cells in a first position relative to said kinetic force apparatus when a force up to at least said second kinetic force impinges upon said first and second layers, wherein, said first layer, said second layer, and said plurality of cells are adapted to release said plurality of third layers when said first kinetic force impinges upon said first and second layers when said kinetic force apparatus is detonated and substantially tears at least said first layer, where said first kinetic force is greater than a tensile strength of said first and second layers, wherein said first and second layers have a respective first and second material property adapted to provide substantial resistance to abrasion and loss of integrity, and wherein said third layer comprises a material and shape selected such that said third layer substantially retains structural integrity and absorbs said first kinetic force and retains a level of kinetic energy above a second kinetic force sufficient to substantially produce an impact or damage event within a predetermined radius from said kinetic force apparatus when said kinetic force apparatus is detonated.

24. The augmentation device as in claim 23, wherein said third layer comprises a means adapted to reduce injury from impact of said third layer.

25. The augmentation device as in claim 24, wherein said means adapted to reduce injury comprises said third layer being substantially shaped to reduce a likelihood of injury from an impact by said third layer when it is ejected from said augmentation device from said first force.

26. The augmentation device as in claim 25, wherein said means adapted to reduce injury further comprises said third layer being substantially shaped to reduce a likelihood of injury from said impact by said third layer.

27. The augmentation device as in claim 26, wherein said third layer is formed with at least one rounded corner.

28. The augmentation device as in claim 27, wherein said means adapted to reduce injury further comprises said third layer substantially comprising a material formed to reduce a likelihood of injury from said impact.

29. The augmentation device as in claim 28, wherein said means adapted to reduce injury wherein said third layer being substantially formed of hardened rubber.

30. The augmentation device as in claim 23, wherein said at least one of said cells further comprises a marking substance section adapted for marking a person within range of said augmentation device when said force is applied against said marking substance section.

31. A trespass reduction system for a motor vessel utilizing augmentation devices used in conjunction with an associated source of kinetic energy to reduce an entry of an unwanted guest, comprising:

a plurality of kinetic force apparatuses;

a plurality of augmentation devices, each augmentation device comprising an enclosing structure with a movable cover and the enclosing structure is conformed to selectively retain and release and substantially encapsulate said associated kinetic force apparatus, the augmentation device having a first side and a second side, the first side of said augmentation device comprising a first lined flexible material, the second side of said augmentation device comprising a second lined flexible material, said first side of said augmentation device being substantially away from a side of a vessel, said second side of said augmentation device being substantially close to said side of said vessel, said first lined flexible material comprises a plurality of cells formed into the first and second layers, wherein said plurality of cells are adapted to retain a plurality of third layers respectively within each of said cells when a force up to at least a second kinetic force impinges upon said first and second layers, wherein said first layer, said second layer, and said plurality of cells are adapted to release said plurality of third layers when a kinetic force impinges upon said first and second layers when said kinetic force apparatus is detonated and substantially tears at least said first layer, where said first kinetic force is greater than a tensile strength of said first and second layers, said first kinetic force being greater than said second kinetic force, wherein said third layer comprises a material and shape selected such that said third layer substantially retains structural integrity and absorbs said first kinetic force and retains a level of kinetic energy above said second kinetic force sufficient to substantially produce an impact or damage event within a predetermined radius from said kinetic force apparatus when said kinetic force apparatus is detonated; and a trigger system coupled to each of said plurality of kinetic force apparatuses.

32. The trespass reduction system of claim 31, wherein said trigger system is a manual trigger.

33. The trespass reduction system of claim 31, wherein said trigger system is an automatic trigger.

34. An intruder deterrent system, comprising:

at least one kinetic force apparatus;

at least one augmentation devices, said augmentation device comprising an enclosing structure with a movable cover and the enclosing structure is conformed to selectively retain and release and substantially encapsulate said associated kinetic force apparatus, the augmentation device having a first side and a second side, the first side of said augmentation device comprising a first lined flexible material, the second side of said augmentation device comprising a second lined flexible material, said first side of said augmentation device being adapted to face towards intended targets, said second side of said augmentation device being adapted to face towards non-targets, said first lined flexible material comprises a plurality of cells formed into a first and second layer, wherein said plurality of cells are adapted to retain a plurality of third layers respectively within each of said cells when a force up to at least said a kinetic force impinges upon said first and second layers, wherein said first layer, said second layer, and said plurality of cells are adapted to release said plurality of third layers when said a kinetic force impinges upon said first and second layers when said kinetic force apparatus is detonated and substantially tears at least said first layer, where said first kinetic force is greater than a tensile strength of said first and second layers, said first kinetic force being greater than said second kinetic force, wherein said third layer comprises a material and shape selected such that said third layer substantially retains structural integrity and absorbs said first kinetic force and retains a level of kinetic energy above said second kinetic force sufficient to substantially produce an impact or damage event within a predetermined radius from said kinetic force apparatus when said kinetic force apparatus is detonated; and a trigger system coupled to said kinetic force apparatus.

35. The intruder deterrent system of claim 34, further comprising:

said second lined flexible material comprises a second plurality of cells formed into a fourth and fifth layer, wherein said second plurality of cells are adapted to retain a plurality of sixth layers respectively within each of said cells when a force up to at least said a second kinetic force impinges upon said fourth and fifth layers, wherein said fourth layer, said fifth layer, and said second plurality of cells are adapted to substantially retain said second plurality of cells when said kinetic force impinges upon said fourth and fifth layers when said kinetic force apparatus is detonated.

36. The trespass reduction system of claim 34, wherein said trigger system is a manual trigger.

37. The trespass reduction system of claim 34, wherein said trigger system is an automatic trigger.

38. An augmentation device as in claim 1, wherein said kinetic force apparatus further comprises a plurality of apertures adapted to vent said gas, said plurality of cells comprise a first plurality of cells, wherein said first plurality of cells are formed in said enclosing structure to permit said first plurality of cells to be aligned over said apertures when said kinetic force apparatus is inserted into said enclosing structure.

39. An augmentation device as in claim 12, wherein said kinetic force apparatus further comprises a plurality of apertures adapted to vent said gas, said plurality of cells comprise a first plurality of cells, wherein said first plurality of cells are formed in said enclosing structure to permit said first plurality of cells to be aligned over said apertures when said kinetic force apparatus is inserted into said enclosing structure.

40. An augmentation device as in claim 23, wherein said kinetic force apparatus further comprises a plurality of apertures adapted to vent said gas, said plurality of cells comprise a first plurality of cells, wherein said first plurality of cells are formed in said enclosing structure to permit said first plurality of cells to be aligned over said apertures when said kinetic force apparatus is inserted into said enclosing structure.

41. An augmentation device as in claim 1, wherein said first and second flexible layers are formed from a material that does not substantially absorb said first kinetic force from said explosive device thereby permitting substantially all of said first kinetic force to be received by said third layer.

* * * * *